United States Patent [19]

Pajak

[11] Patent Number: 4,948,927

[45] Date of Patent: Aug. 14, 1990

[54] VISCO-ELASTIC DELAYED ACTUATOR AND SYSTEM

[75] Inventor: Vic Pajak, Wayne, N.J.

[73] Assignee: Piezo Electric Products, Inc., Metuchen, N.J.

[21] Appl. No.: 252,647

[22] Filed: Oct. 3, 1988

[51] Int. Cl.[5] ..... H01H 7/00

[52] U.S. Cl. ..... 200/33 R; 200/34; 239/56; 239/57

[58] Field of Search ..... 200/33 R, 288, 250, 200/251, 34; 239/44, 56, 57, 70; 222/638

[56] References Cited

U.S. PATENT DOCUMENTS

| | | | |
|---|---|---|---|
| 3,585,320 | 6/1971 | Goldstein | 200/33 R |
| 4,742,189 | 3/1988 | Carter et al. | 200/33 R |
| 4,791,251 | 12/1988 | Carter et al. | 200/33 R |

*Primary Examiner*—J. R. Scott

*Attorney, Agent, or Firm*—Joseph S. Iandiorio

[57] ABSTRACT

A visco-elastic delayed actuator and system are provided, including a visco-elastic delayed actuator which includes a restorable and collapsible structure having at least two confronting surfaces and a resilient member interconnecting the surfaces. A visco-elastic delay member including visco-elastic adhesive on at least one of the confronting surfaces of the structure provides a visco-elastic holding force when the confronting surfaces come into mutual contact with the visco-elastic adhesive. The delayed actuator system also includes a support section and an operator member mounted in the support section. A resilient member in the structure biases the operator member in a first state while permitting the operator member to be selectively switched to a second state, thereby initiating a visco-elastic delay period. In the second state, the collapsible, restorable structure is held in the collapsed position by the visco-elastic holding force of the visco-elastic adhesive coming into contact with the confronting surfaces of the structure. The resilient member in the structure gradually urges apart the adhered confronting surfaces, generally restoring the structure and moving the actuator towards its initial position to end the visco-elastic delay period.

29 Claims, 3 Drawing Sheets

VISCO-ELASTIC DELAYED ACTUATOR AND SYSTEM

FIELD OF INVENTION

This invention relates to a visco-elastic delayed actuator system and to a self-contained and self-restoring visco-elastic delayed actuator usable therein.

BACKGROUND OF INVENTION

Time delayed actuators are widely employed to switch relay contacts, open and close fluid control valves, and operate many other types of mechanisms. Electrical and electronic timers are perhaps the most commonly used devices of this type. In certain applications, however, such timers are impractical because of their expense, complexity and/or need for a power supply.

As an alternative to the electrical timer, a dashpot type of delayed actuator may be utilized. This mechanism includes a piston disposed within a fluid-filled cylinder. As the piston is moved through the cylinder, fluid is forced through a circumferential gap between the piston and the cylinder wall so that the piston gradually changes from a first state to a second state.

A rotary plate delayed actuator is used to slow the motion of cassette tape machine doors and record player armatures. This device employs a pair of parallel plates that are separated by a layer of viscous fluid. Torque is applied to one of the plates while the other is held fixed, and the viscous drag of the fluid slows the motion of the movable plate.

Typically, dashpot and rotary plate devices are effective for providing delays of only a few seconds. In order to extend their delay periods, their fluid reservoirs must be made impractically large. Increasing the delay of the dashpot device requires making the circumferential gap exceedingly and impractically small. Moreover, both devices must be hermetically sealed to prevent escape or contamination of the fluid, and each requires at least one precision tolerance (i.e., the dashpot piston/cylinder clearance and the rotary plate spacing) which adds significantly to the cost of the device.

There is a particular need for an inexpensive, easy to manufacture, and effective time delayed actuator system for the dispensing of fragrances, insecticides, and other airborne fluids. Present dispensers are typically either passive or active. Passive devices employ a container filled with a fluid. A wick protruding from the fluid-filled container absorbs the fluid and emits it into the air. These systems do not employ extremely volatile fluids because such fluids evaporate too rapidly. As a result, the dispensing rate of these devices is often not sufficient to perform the function desired, e.g., the elimination of offensive odors.

Less volatile fluids may be dispensed more effectively with an active device that employs an electric blower or heater to stimulate emission. However, such devices are fairly expensive and again require a source of electrical power.

Prior art devices, such as Carter et al. U.S. Pat. No. 4,742,189 and U.S. Pat. No. 4,791,251, disclose visco-elastic delayed actuators which have adequately long timing periods of minutes to hours. However, they are difficult to manufacture because the adhesive itself must be applied directly to the engaging surfaces in such a way as to precisely control layer thickness and final consistency. This generally requires an above boiling temperature pressurized delivery system with a particular temperature gradient in the delivery lines and, additionally, a specially designed nozzle. This requirement makes final assembly of prior art devices messy and time consuming. It additionally requires that a new delivery system be designed, constructed, and debugged each time a new device geometry is contemplated.

SUMMARY OF INVENTION

It is therefore an important object of this invention to provide a self-contained and self-restoring visco-elastic delayed actuator.

It is a further object of this invention to provide such visco-elastic delayed actuator which is simple and easy to manufacture.

It is a further object of this invention to provide a visco-elastic delayed actuator which minimizes contamination of the visco-elastic adhesive.

It is a further object of this invention to provide a visco-elastic delayed actuator which can be easily adapted to a wide variety of uses and systems.

It is a still further object of this invention to provide a simple and improved visco-elastic delayed actuator system utilizing a visco-elastic delayed actuator.

It is a further object of this invention to provide a visco-elastic delayed actuator system to serve as a dispenser for a medium.

It is a further object of this invention to provide a visco-elastic delayed actuator that remains in a first state for extended periods of time and then rapidly, reliably, and automatically switches to a second state virtually instantaneously at the end of the timing cycle.

This invention results from the realization that a self-restoring, self-contained visco-elastic actuator can be constructed which utilizes the restoring force of the actuator itself to oppose, over time, the holding force of the visco-elastic adhesive; and from the realization that a truly effective visco-elastic delayed actuator system can be achieved using the self-contained, self-restoring visco-elastic actuator to directly drive the operator member, such as a valve, which operates the ports in a dispensing system.

This invention features a visco-elastic delayed actuator and system. The visco-elastic actuator includes a restorable and collapsible structure having at least two confronting surfaces and resilient means interconnecting the surfaces. Visco-elastic delay means are provided in the actuator by including visco-elastic adhesive on at least one of the confronting surfaces of the structure, to provide a visco-elastic holding force when the other confronting surface comes into contact with the visco-elastic adhesive. Gradually, the resilient means urge apart the adhered confronting surfaces to overcome the visco-elastic adhesive holding force, generally restoring the structure.

The delayed actuator system includes a support section and operator means mounted in the support section. The operator means is located proximate one of the confronting surfaces of the structure and adapted to force together the confronting surfaces and collapse the structure, thereby allowing the operator means to move into a secondary position initiating a visco-elastic delay period. Over time, the resilient means overcomes the visco-elastic adhesive holding force generally restoring the structure to its original shape which moves the operator from its secondary position into its initial position, ending the visco-elastic delay period.

The visco-elastic delayed actuator system may be a dispenser for a medium, wherein the support member may include a compartment for containing a medium to be dispensed. The compartment also includes venting means for dispensing the medium. Closure means may be provided for closing the venting means in response to the operator means being in one of the first or second states. Such closure means also acts to open the venting means in response to the operator means being in the other state.

In a preferred embodiment, the operator means may be mounted to the support member. Alternatively, the support member may include means for constraining the operator means within the support member. The operator means may be attached to the collapsible and restorable structure, and in addition, the operator means may include valving means. Additionally, the restorable structure may be attached to the support member.

The actuator may be a closed geometric shape with an air vent or may be an annulus and may include foam rubber or a plastic material and may be homogeneous. The inner surface of the annulus may be coated with visco-elastic adhesive. In addition, the restorable structure may be electrically conductive on at least a portion of its outer surface. The resilient means may include bellows or spring means and may be in only a portion of the structure.

BRIEF DESCRIPTION OF THE DRAWINGS

Other objects, features, and advantages will occur from the following description of a preferred embodiment and the accompanying drawings, in which.

DESCRIPTION OF THE PREFERRED EMBODIMENTS

A visco-elastic delayed actuator according to this invention is accomplished using a collapsible and restorable structure including at least two confronting surfaces. The structure may also be in the form of a closed geometrical shape having an air vent and at least two confronting surfaces. The actuator provides a visco-elastic delay by including a supply of visco-elastic adhesive on the interior of at least one of the confronting surfaces of the structure. Once the actuator is collapsed, the other confronting surface comes into contact with the visco-elastic adhesive. The visco-elastic adhesive generates a visco-elastic adhesive holding force which keeps the actuator collapsed.

The visco-elastic adhesive material typically comprises a sticky, elastic, and viscous substance such as STICK-EM ™ brand mousetrap glue manufactured by T. F. Eaton and Company. The material exhibits the required properties of elasticity and viscosity. The elasticity allows the material to be easily deformed or shaped, while the viscosity slows the return of the material to its original shape, thereby providing the required time delay period. A specific visco-elastic adhesive may be selected to provide a time delay of minutes to hours, and even days.

The actuator also provides, within itself, resilient means for urging apart the adhered confronting surfaces of the structure, generally restoring the actuator to its original size. The structure itself may comprise the resilient means. In such cases, the structure may be only partially resilient or may be a homogeneous, completely resilient structure such as an annulus of foam rubber tubing or of a plastic material. Alternatively, the resilient means may be provided by a spring or bellows integrally connected with the two confronting surfaces of the structure.

The visco-elastic delayed actuator may be used as an actuator in any type of delayed actuator system. This may be accomplished by providing, in addition to the actuator, a support section and an operator member.

The delayed actuator system may be a dispensing system wherein the support section includes a compartment which contains a medium to be dispensed, as well as ports or vents through which the vaporized medium can flow. When the operator of the mechanism is in one position, it blocks the vents, thereby preventing the medium from being dispensed. When the operator is depressed or switched to a second position, the ports or vents are opened, thereby allowing the medium to vaporize and be dispensed.

The actuator keeps the operator in a first state. The operator is movably mounted in or on a support section to allow it be moved, thereby collapsing the actuator and beginning the delay period. The operator may operate a valve or may itself be a valve. In another embodiment, the operator may operate an electrical switch such as a light switch. Additionally, the actuator itself may serve as a switch.

Figure 1:
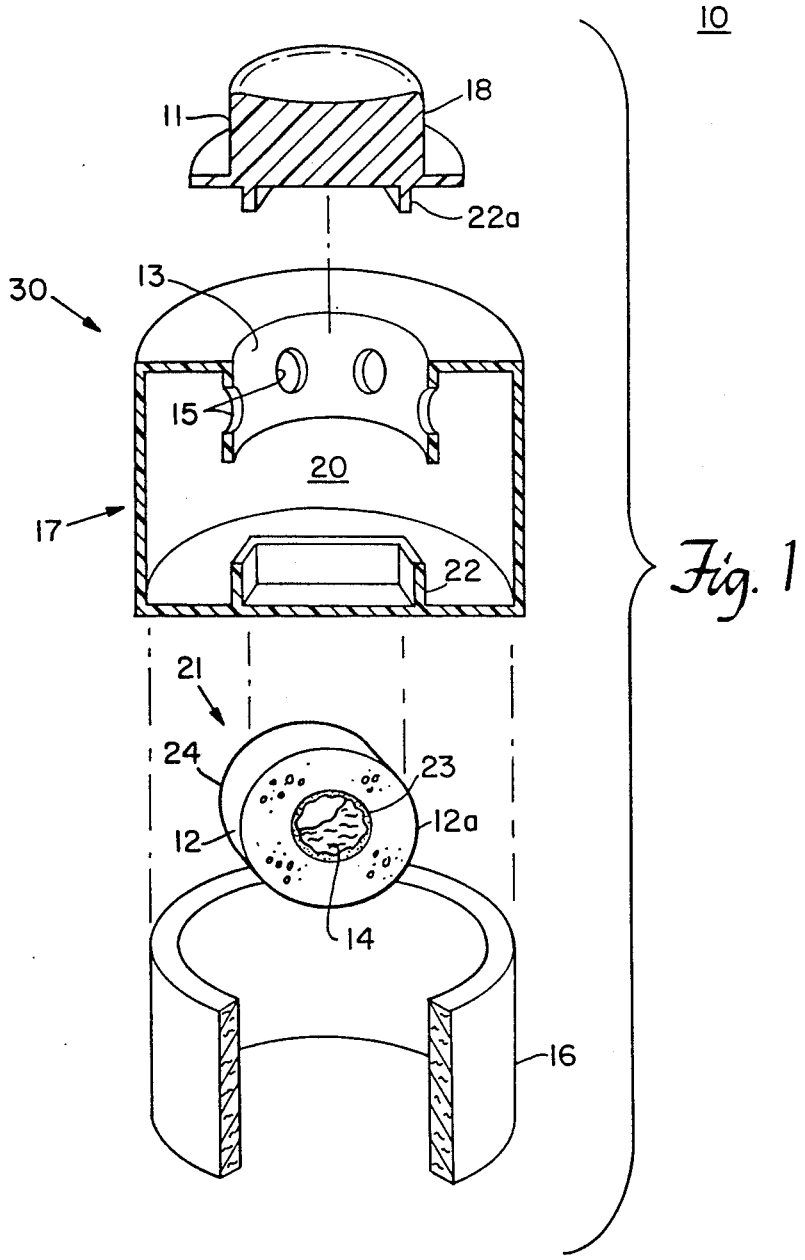
FIG. 1 is an exploded cross-sectional view of a visco-elastic delayed actuator system used for dispensing a medium.

There is shown in FIG. 1 visco-elastic delayed actuator system 10 according to this invention in the form of dispenser 30. Dispenser 30 includes housing 17 which contains cylindrical guide portion 13 that serves to guide the motion of operator 11 via sliding contact with the operator's cylindrical surface 18. Cylindrical guide portion 13 is also provided with several large vents or ports, 15. Housing 17 includes compartment 20 which contains a loosely fitting cylinder of absorbent material 16 which is impregnated with volatile fluid. Also located within the housing is self-contained visco-elastic delayed actuator 21, including resilient structure 24 which consists of an annulus of cylindrical foam rubber tubing having resilient sidewalls 12 and **12*a*. The inner wall 23 of resilient structure 24 is coated with a layer of visco-elastic adhesive 14. The outer walls of delayed actuator 21 are engaged and retained by retaining rings 22, 22*a* which are raised up from the inner surfaces of housing 17 and operator 11**, respectively.

Figure 2A:
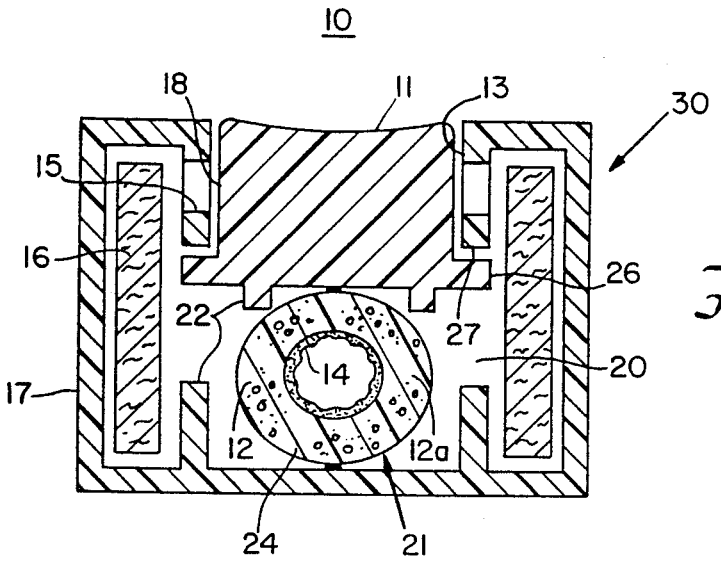
FIG. 2A is a cross-sectional view of a visco-elastic delayed actuator system for dispensing a medium with the actuator adapted to force the operator member into an initial state, closing the dispensing vents of the system.
Figure 2B:
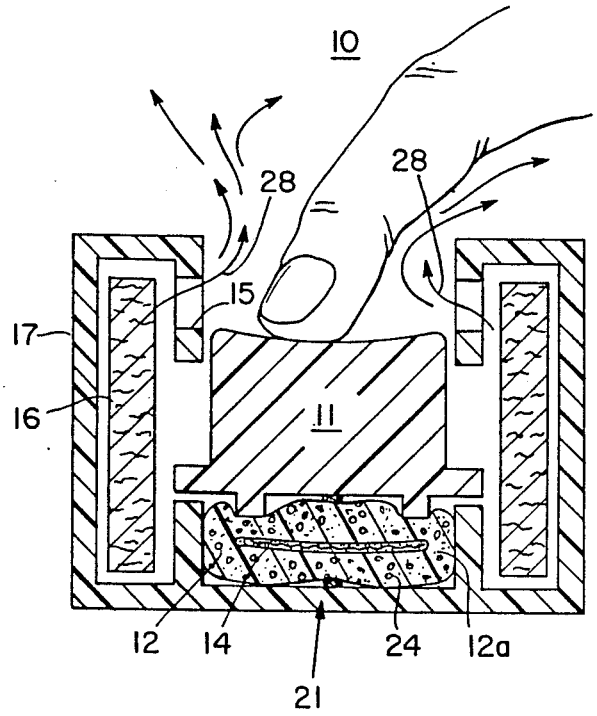
FIG. 2B is a cross sectional view similar to that of FIG. 2A with the operator in the second state after the operator member has compressed the visco-elastic actuator and opened the dispensing vents of the system.

Operation of these various components may be understood with reference to FIGS. 2A and 2B which are cross-sectional views of dispenser 30 in FIG. 1. In FIG. 2A, dispenser 30 is in a first state wherein lip portion 26 of operator 11 is urged against the lower surface 27 of guide portion 13 of housing 17 by resilient sidewalls 12 and 12*a* of resilient structure 24. In this first state, sliding surface 18 of actuator 11 blocks the escape of vapors from the vents or ports 15. Cylindrical guide portion 13 holds operator 11 in position, keeping it from sliding out of place.

When operator 11, FIG. 2B, is pressed downward so that delayed actuator 21 is collapsed, its inner walls, which are coated with visco-elastic adhesive 14, become temporarily stuck together, thus allowing the operator to remain in a second position. In this position, diffusion path 28 is open through ports 15 allowing evaporation of the volatile liquid which is impregnated in absorbent material 16. The dispensing of the volatile liquid continues as long as the device remains in this second state.

Gradually, over time, the resilient means of sidewalls 12, 12*a* of resilient structure 24 overcome the visco-elastic adhesive holding forces of adhesive 14; and the actuator generally regains its original shape, restoring the operator to its initial state, thereby blocking ports 15.

Figure 3A:
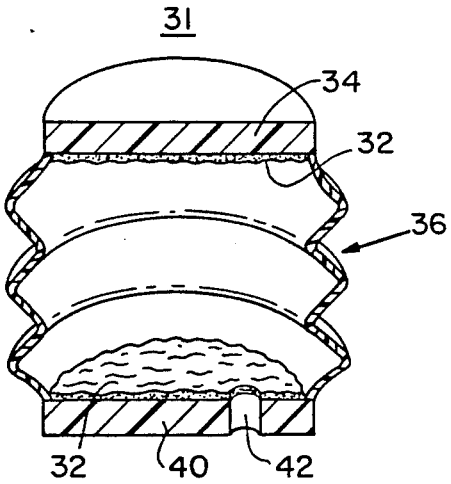
FIGS. 3A and 3B are cross-sectional views of alternative visco-elastic actuators.
Figure 3B:
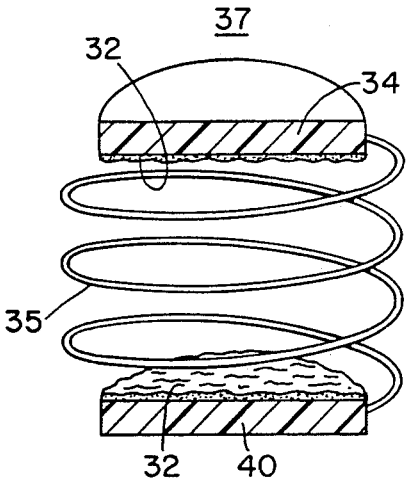

An alternative resilient structure 31 is shown in FIG. 3A, wherein only a portion of the structure is resilient. Confronting surfaces 34 and 40 are coated with visco-elastic adhesive 32. One surface is provided with air vent 42 open to the environment to allow compressed air to escape and return upon expansion. Connecting the two confronting surfaces and providing the resilient means to overcome the visco-elastic adhesive holding force are bellows 36. Alternatively, the resilient means 37 may be provided by integral spring means 36 noting FIG. 3B.

Figure 4:
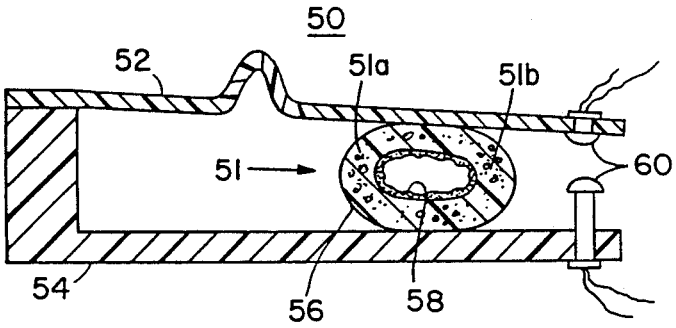
FIG. 4 is an elevational cross-sectional view of a visco-elastic delayed actuator system operating a set of electrical contacts.

An alternative visco-elastic delayed actuator system 50 including actuator 51 is shown in FIG. 4. Delayed actuator system 50 consists of mounting platform 54 to which is attached armature 52. Attached to the other end of armature 52 and platform 54 are electrical contacts 60. Located between the armature and the mounting platform is resilient structure 56 of delayed actuator 51. The interior of the structure is coated with visco-elastic adhesive 58. When resilient structure 56 is squeezed between armature 52 and mounting platform 54, it is collapsed, which causes its confronting surfaces to become temporarily held together by the visco-elastic holding force of visco-elastic adhesive 58, thus allowing the armature to attain a position which causes electrical contacts 60 to touch and complete an electrical circuit.

As time elapses, the resilient means of sidewall portions 51*a*, 51*b*, of resilient structure 56, tend to generally restore it to its original shape against the force of the visco-elastic adhesive and contacts 60 are forced apart.

Figure 5A:
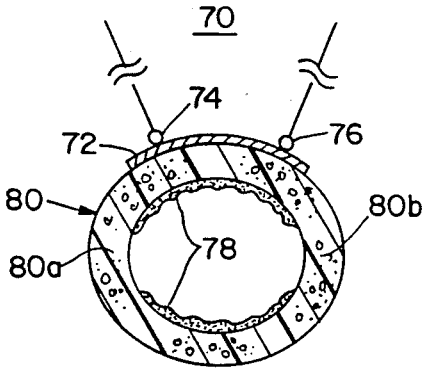
FIG. 5A is an elevational cross-sectional view of a visco-elastic delayed actuator wherein a portion of the surface of the structure is conductive, making an electrical path between two electrical contacts.
Figure 5B:
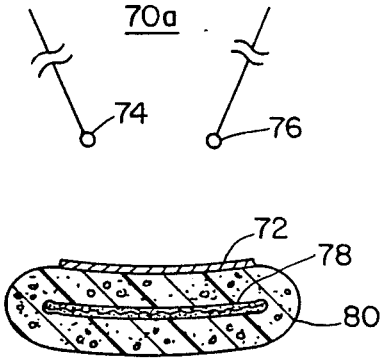
FIG. 5B is a view similar to FIG. 5A with the visco-elastic actuator compressed, breaking the electrical path.

An alternative delayed actuator 70 is disclosed in FIGS. 5A and 5B. The actuator includes resilient structure 80 comprising an annulus of foam rubber tubing which has part of its interior wall coated with visco-elastic adhesive 78. In addition, part of its outer surface is coated with conductive material 72 such that when the structure is in its initial state (FIG. 5A), conductive outer surface 72 makes an electrical path between contacts 74 and 76. Once collapsed, shown as actuator 70*a*, in FIG. 5B, resilient structure 80 is compressed, and its interior walls become temporarily held together by the adhesive action of visco-elastic adhesive 78, thereby removing outer conductive surface 72 from contact with electrical contacts 74 and 76. Gradually, over time, the restoring force in side portions 80*a*, 80*b* of resilient structure 80 tend to generally restore the structure to its original shape, thereby completing an electrical path through contacts 74, 76.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A visco-elastic delayed actuator system comprising:

a visco-elastic delayed actuator including a restorable, collapsible structure having at least two confronting surfaces, resilient means having a first portion directly connected to one said surface and having a second portion directly connected to the other said surface, and visco-elastic delay means including visco-elastic adhesive on at least one of said confronting surfaces of said structure for providing a visco-elastic holding force when said other confronting surface comes in contact with said visco-elastic adhesive;

a support member for receiving said structure; and operator means proximate one of said confronting surfaces of said structure in an initial position and adapted to force together the confronting surfaces of said structure, said operator means adapted to move into a secondary position, initiating a visco-elastic delay period, said resilient means urging apart said confronting surfaces to overcome said visco-elastic adhesive holding force and separate said confronting surfaces, generally restoring said structure, moving the operator means toward its initial position and ending the visco-elastic delay period.

2. The system of claim 1 in which said operator means is mounted to said support member.

3. The system of claim 1 in which said support member includes means for constraining said operator means within said support member.

4. The system of claim 1 in which said operator means is attached to said restorable structure.

5. The system of claim 1 in which said operator means includes valving means.

6. The system of claim 1 in which said restorable structure is attached to said support member.

7. The system of claim 1 in which said restorable structure includes foam rubber.

8. The system of claim 1 in which said restorable structure includes a plastic material.

9. The system of claim 1 in which said restorable structure is homogeneous.

10. The system of claim 1 in which said restorable structure is electrically conductive on at least a portion of its outer surface.

11. The system of claim 1 in which said resilient means are bellows.

12. A visco-elastic delayed actuator system for dispensing a medium comprising:

a delayed actuator including a collapsible and restorable structure having at least two confronting surfaces, resilient means interconnecting said surfaces, and visco-elastic delay means including visco-elastic adhesive on at least one of said confronting surfaces of said structure providing a visco-elastic holding force when said confronting surfaces and said visco-elastic adhesive come into mutual contact;

a support member for supporting said structure;

compartment means in said support member for storing a medium to be dispensed;

venting means in said compartment means for allowing dispensing of said medium; and operator means proximate one of said confronting surfaces of said structure in an initial position and adapted to force together the confronting surfaces of said structure, said operator means adapted to move into a secondary position, allowing dispensing of said medium and initiating a visco-elastic delay period, said resilient means urging apart said confronting surfaces to overcome said visco-elastic adhesive holding force, generally restoring said actuator and moving the operator means toward its initial position, preventing the dispensing of said medium and ending said visco-elastic delay period.

13. The system of claim 12 in which said support member includes means for constraining said operator means within said support member.

14. The system of claim 12 in which said operator means includes valving means.

15. A visco-elastic delayed actuator comprising:

an elastomeric collapsible and restorable structure having at least two confronting surfaces, and resilient means interconnecting said surfaces; and visco-elastic delay means including visco-elastic adhesive on at least one of said confronting surfaces of said structure for providing a visco-elastic adhesive holding force when said confronting surfaces and said visco-elastic adhesive come into mutual contact, said resilient means urging apart said adhered confronting surfaces to overcome said visco-elastic adhesive holding force, generally restoring said structure.

16. The actuator of claim 15 in which said visco-elastic adhesive is located on both confronting surfaces of said structure.

17. The actuator of claim 15 in which said structure is homogeneous.

18. The actuator of claim 17 in which said structure includes foam rubber.

19. The actuator of claim 1 in which said structure includes a plastic material.

20. The actuator of claim 15 in which said structure is an electrically conductive on at least a portion of its outer surface.

21. The actuator of claim 15 in which said structure is an annulus.

22. The actuator of claim 15 in which said resilient means includes bellows.

23. The actuator of claim 15 in which only a portion of said structure is resilient.

24. The actuator of claim 15 in which said resilient means includes spring means.

25. The actuator of claim 15 in which said structure includes a closed geometric shape having an air vent.

26. A visco-elastic delayed actuator comprising:

a homogeneous collapsible and restorable closed structure having at least two confronting surfaces and resilient means integral with said homogeneous structure; and visco-elastic delay means including visco-elastic adhesive on at least one of said confronting surfaces of said structure for providing a visco-elastic adhesive holding force when said confronting surfaces and said visco-elastic adhesive come into mutual contact, said resilient means urging apart said confronting surfaces to overcome said visco-elastic adhesive holding force, and generally restoring said structure.

27. The actuator of claim 15 in which said structure is an annulus.

28. The actuator of claim 27 in which said annulus includes foam rubber.

29. The actuator of claim 26 in which said homogeneous structure includes an air vent.

* * * * *